US011417510B2

(12) United States Patent
Kratish

(10) Patent No.: US 11,417,510 B2
(45) Date of Patent: Aug. 16, 2022

(54) BROKEN LIGHT BULB EXTRACTOR AND LIGHT BULB CHANGER

(71) Applicant: Lawrence Kratish, Panama City, FL (US)

(72) Inventor: Lawrence Kratish, Panama City, FL (US)

( * ) Notice: Subject to any disclaimer, the term of this patent is extended or adjusted under 35 U.S.C. 154(b) by 255 days.

(21) Appl. No.: 16/657,350

(22) Filed: Oct. 18, 2019

(65) Prior Publication Data

US 2021/0118664 A1 Apr. 22, 2021

(51) Int. Cl.
*H01K 3/32* (2006.01)
*B25B 9/00* (2006.01)
*B25B 13/48* (2006.01)

(52) U.S. Cl.
CPC ..... *H01K 3/32* (2013.01); *B25B 9/00* (2013.01); *B25B 13/481* (2013.01)

(58) Field of Classification Search
CPC .. H01K 3/32; H01K 3/30; H01K 3/305; H01J 9/006; H01J 9/003; B25B 9/00; B25B 9/02; B25B 9/04; B25B 1/007; B25B 13/48; B25B 13/481; B25B 11/007
See application file for complete search history.

(56) References Cited

U.S. PATENT DOCUMENTS 1,056,084 A * 3/1913 Bates ..... H01K 3/32 81/53.12
1,319,028 A * 10/1919 Grinnell ..... B25B 27/18 81/441
3,549,188 A * 12/1970 Cerasoli ..... H01K 3/32 81/53.12
4,485,701 A 12/1984 Hough
5,148,723 A * 9/1992 Newman, Sr. ..... H01J 9/003 81/53.11
5,490,438 A 2/1996 Zupo et al.
5,829,324 A * 11/1998 Secor ..... H01K 3/32 81/436
6,553,872 B1 * 4/2003 Tse ..... H01K 3/32 81/53.11
6,739,219 B1 * 5/2004 Cuevas ..... H01J 9/003 81/53.11
6,904,830 B1 6/2005 Desaulniers
7,066,511 B2 * 6/2006 Newman ..... F16B 7/149 294/210

(Continued)

FOREIGN PATENT DOCUMENTS

EP 3245445 B1 7/2019

*Primary Examiner* — Robert J Scruggs
(74) *Attorney, Agent, or Firm* — Laurence A. Greenberg; Werner H. Stemer; Ralph E. Locher

(57) ABSTRACT

A light bulb remover extracts a broken light bulb from a socket of a high-hat light fixture. The light bulb remover has an extension pole and an extractor head attached to the extension pole. The extractor head has a guide which defines an outer circumference of the extractor head and a bulb extractor configured for engaging in a base of the broken light bulb and creating a friction connection with the base of the light bulb. The bulb extractor is surrounded by the guide, and the guide has a diameter being less than a diameter of the high-hat light fixture and dimensioned so that when the light bulb remover is disposed within the high-hat light fixture the bulb extractor is self-aligned with a middle area of the base of the broken light bulb.

14 Claims, 5 Drawing Sheets

(56) References Cited

U.S. PATENT DOCUMENTS

| | | | | |
|---|---|---|---|---|
| 7,131,352 | B1 | 11/2006 | Saunders | |
| 7,631,579 | B2 * | 12/2009 | Johnson | H01J 9/003 81/53.12 |
| 8,516,925 | B2 * | 8/2013 | Johnson | B25B 13/48 81/53.12 |
| 8,646,362 | B2 * | 2/2014 | Schildmeier | H01K 3/32 81/53.11 |
| 9,093,241 | B1 * | 7/2015 | Gatski | H01J 9/003 |
| 2011/0247462 | A1 * | 10/2011 | Schildmeier | H01K 3/32 81/53.11 |
| 2012/0247285 | A1 * | 10/2012 | Eyre | B25B 13/48 81/436 |
| 2018/0308654 | A1 | 10/2018 | Harrington et al. | |

* cited by examiner

BROKEN LIGHT BULB EXTRACTOR AND LIGHT BULB CHANGER

BACKGROUND OF THE INVENTION

Field of the Invention

The invention relates, generally, to a light bulb extractor for removing and replacing light bulbs from a light bulb socket and is especially configured for removing broken light bulbs from high-hat light fixtures disposed in a ceiling.

A typical residential or commercial lighting device consists of a socket that holds a replaceable light bulb threaded into the socket. Such lighting devices require replaceable light bulbs that have different sizes and/or shapes which vary depending on a number of different factors. The different sizes and/or shapes of the light bulbs can become problematic during routine replacement of the bulbs, particularly when the location of the socket is in an elevated location such as on a wall or a ceiling. Particular difficulties occur with a type of light known as a high-hat light fixture which is a light that is recessed into a ceiling where the ceiling may be 15-20 feet high in relation to the ground floor. In addition, should the bulb's glass casing have shattered, the difficulty of extracting the light bulb has increased exponentially.

A number of different prior art devices have been proposed to accommodate different light bulbs of different sizes and shapes. Generally these devices include a bulb gripper on an extension pole, where the bulb gripper can grip or hold a bulb with a gripping force such that rotation of the extension pole applies a rotational force to the bulb so that the bulb is threadably secured to and/or unsecured from a light socket. As used herein the term "gripping force" refers to the force applied by the device to temporarily hold the bulb in a desired position before/after/during installation, while the term rotational force refers to the application of torque to the bulb during installation/removal.

U.S. patent publication No. 2018/0308654 to Harrington et al. teaches such a light bulb replacement device. Harrington teaches that a top region of the handle is widened and holds multiple sized holding devices for holding and removing various sized bulb. In addition, the top region is provided with teeth for assisting in removing a broken bulb and has a catch or widened region for catching broken glass.

U.S. patent publication No. 2012/0247285 to Eyre teaches a utility grip for extracting broken glass bulbs. The utility grip either has a tip or a flared opening for engaging into a broken light bulb so that an appropriate rotational force can be applied to the light bulb for removing the light bulb. The utility grip is configured for receiving an extension pole so that the utility grip may be used for removing light bulbs in a high ceiling.

U.S. Pat. No. 1,319,028 to Grinnell discloses a device for removing broken light bulbs. The device has a tubular structure with a head disposed at one end of the tubular structure. The head has a plurality of angled clutch members for engaging in a base of a light bulb. The head has a reaming member for crushing remaining or interfering glass so that the angled clutch members can engage in the metal base of the light bulb so that a rotational force can be applied for removing the light bulb.

A problem with removing a broken light bulb from a high-hat light fixture, which is disposed 15-20 feet above the floor, is that centering of the bulb base engaging member becomes difficult as the weight of the light bulb removing device causes an individual to shake/sway the light bulb removing device as he/she extends the light bulb removing device toward the broken light bulb. The shaking/swaying of the light bulb removing device increases as the light bulb removing device is extended further away from the individual holding the light bulb extending device. There is a need for a self-centering device which once engaged inside of the high-hat light fixture self-centers the bulb base engaging device into the broken bulb base.

SUMMARY OF THE INVENTION

It is accordingly an object of the invention to provide a broken light bulb extractor and a light bulb changer that overcome the herein-mentioned disadvantages of the heretofore-known devices of this general type, which is configured to self-center itself and align with the base of a broken light bulbs housed in a high-hat light fixture.

With the foregoing and other objects in view there is provided, in accordance with the invention, a light bulb remover for extracting a broken light bulb from a socket of a high-hat light fixture. The light bulb remover has an extension pole with first and second ends and an extractor head attached to the extension pole. The extractor head has a guide which defines an outer circumference of the extractor head. The extractor head has a bulb extractor configured for engaging in a base of the broken light bulb and creates a friction connection with the base of the light bulb. The bulb extractor is surrounded by the guide, and the guide has a diameter being less than a diameter of the high-hat light fixture and dimensioned so that when the light bulb remover is disposed within the high-hat light fixture the bulb extractor is self-aligned with a middle area of the base of the broken light bulb.

In accordance with an added feature of the invention, the guide is cylindrically shaped and completely surrounds the light bulb extractor. Because of the snug fit and cylindrical shape of the light bulb remover, the bulb extractor is automatically centered in the base of the broken light bulb which assists in removal of the broken light bulb as the user merely has to apply pressure (e.g. push) upward towards the high-hat light fixture.

In accordance with another feature of the invention, the bulb extractor has a plurality of blades and a point of intersection of the blades defines a tip for jabbing into the base of the broken light bulb.

In accordance with a further feature of the invention, each of the blades has a first end tapering towards the second end, and the tip is formed where the second ends of the blades meet. Because the blades are tapered they can fit into various sized light bulbs and only one bulb extractor is necessary for variously sized light bulbs.

In accordance with an additional feature of the invention, the extractor head has a circularly shaped bottom.

In accordance with yet another feature of the invention, each of the blades has a lower portion and an upper portion. The lower portion extends up from the circularly shaped bottom, and the upper portion has a first side extending from the lower portion and a second side defining the tip. Ideally, the upper portion is formed from a softer material than the lower portion. In this manner the tip of the extractor head can be squished into the base of the light bulb creating a greater frictional fit between the tip and the base and thus making it easier to extract a broken light bulb.

In accordance with a further added feature of the invention, the first end of the extension pole is a threaded first end and the circularly shaped bottom of the extractor head has a threaded central core for engaging with the threaded first end of the extension pole.

In accordance with a further additional feature of the invention, the extension pole is a telescopic extension pole. Therefore, the user can adjust the length of the extension pole as desired.

In accordance with yet another feature of the invention, the guide is disposed distally from the bulb extractor and forms a pocket for receiving broken glass from the broken light bulb. In this manner, the guide prevents glass from falling down and injuring the user.

In accordance with still another feature of the invention, the bulb extractor extends vertically from the circularly shaped bottom and has a first height, and the guide extends vertically from the circularly shaped bottom and has a second height, wherein the first height is greater than the second height.

In accordance with a feature of the invention, the diameter of the guide is within ¼-¾ inch of the diameter of the high-hat light fixture. The difference in diameter is chosen so that once the light bulb remover fits inside the high-hat light fixture the tip of the bulb extractor is aligned generally in the central area of the base of the bulb. In this manner the tip is always automatically aligned with the base as the guide is always in close engagement with the walls of the high-hat light fixture.

With the foregoing and other objects in view there is further provided, in accordance with the invention, a light bulb replacing system for replacing a light bulb from a high-hat light fixture. The light bulb replacing system includes an extension pole having first and second ends, a bulb attachment head connected to the extension pole and has first and second sides, and a double-sided ring. The double-sided ring has a first side adhesively attached to the second side of the bulb attachment head and a second side with an adhesive layer for attaching to the light bulb to be replaced.

In accordance with an added feature of the invention, the first end of the extension pole is a threaded first end and the bulb attachment head has a circular base plate and a threaded cylindrical core extending from the circular base plate. The threaded cylindrical core engages with the threaded first end of the extension pole.

In accordance with a concomitant feature of the invention, an extractor head is attached to the second side of the double-sided ring. The extractor head has a guide defining an outer circumference of the extractor head. The extractor head has a bulb extractor configured for engaging in a base of a broken light bulb and creates a frictional connection with the base of the broken light bulb. The bulb extractor is surrounded by the guide and the guide has a diameter being less than a diameter of the high-hat light fixture. The guide is dimensioned so that when the light bulb replacing system is disposed within the high-hat light fixture the bulb extractor is self-aligned with a middle area of the base of the broken light bulb.

Other characteristic features of the invention are set forth in the appended claims.

Although the invention is illustrated and described herein as embodied in a broken light bulb extractor and a light bulb changer, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DETAILED DESCRIPTION OF THE INVENTION

Figure 1:
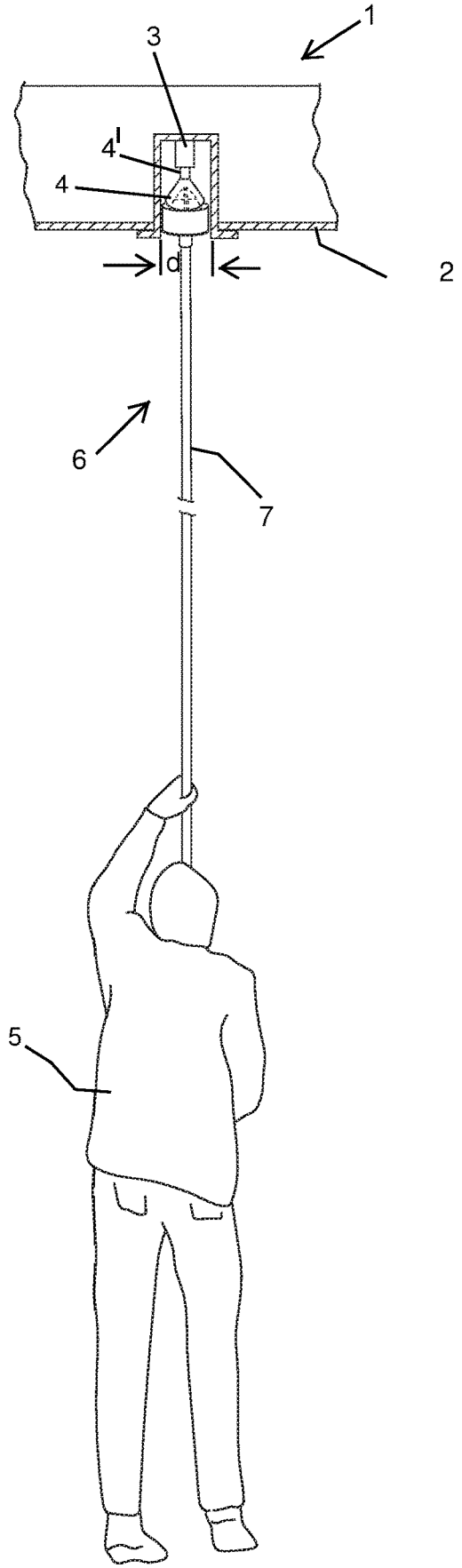
FIG. 1 is an illustration of a light bulb extractor and/or replacing device for installing a new light bulb in a high-hat light fixture.

In all the figures of the drawing, sub-features and integral parts that correspond to one another bear the same reference symbol in each case.

Figure 2:
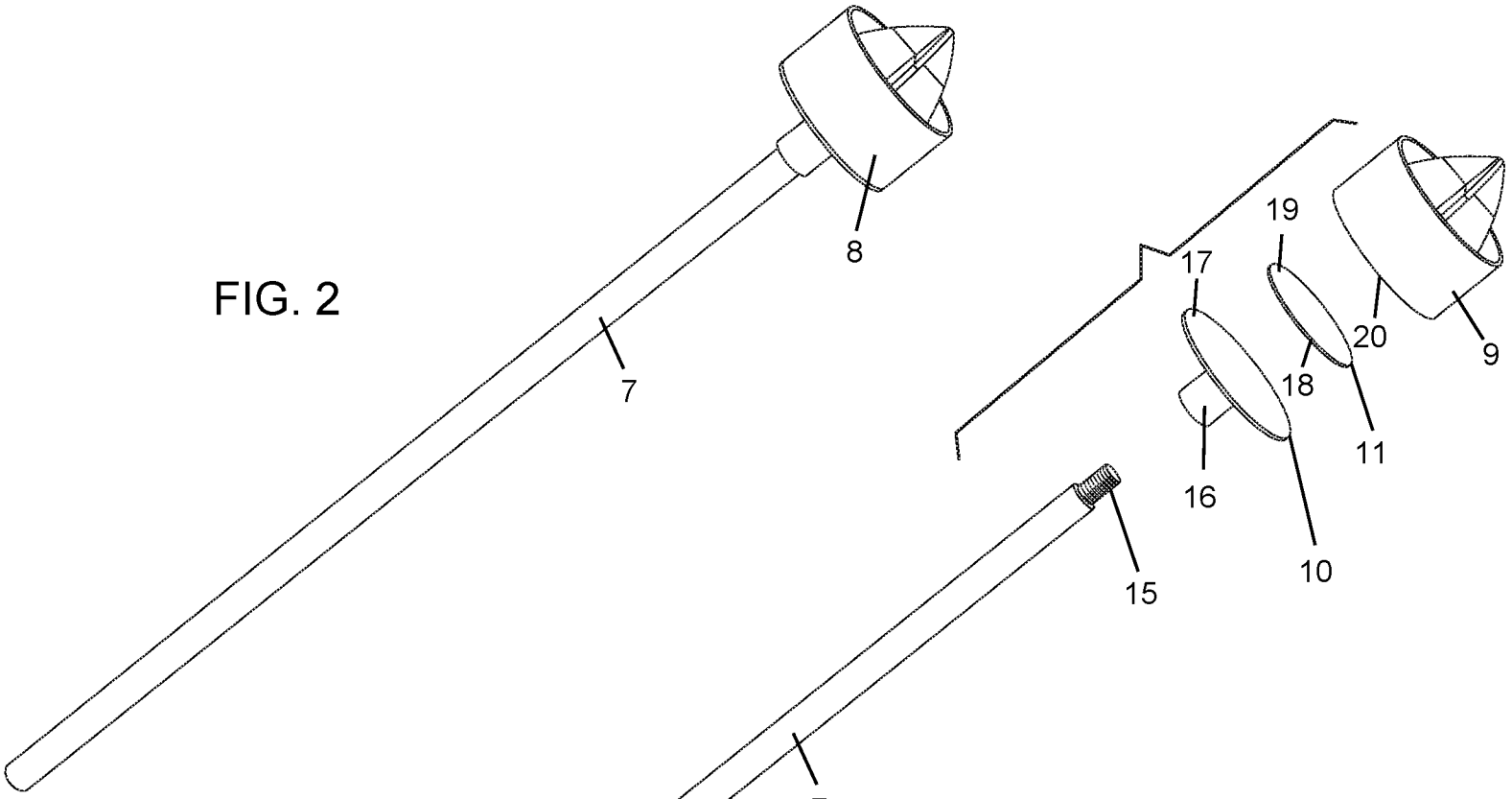
FIG. 2 is perspective view of the light bulb extractor and/or replacement device.

Referring now to the figures of the drawings in detail and first, particularly, to FIGS. 1 and 2 thereof, there is shown a high-hat light fixture 1 disposed or formed in a ceiling 2 and having a light bulb socket 3 holding a base 4' of a light bulb 4. A user 5 is holding a light bulb removing and/or replacing device 6, hereinafter it shall be called a bulb extractor device 6. The bulb extractor device 6 has an extension pole 7 and a bulb removal/replacement head 8. The extension pole 7 is cylindrical in shape and can be a single-piece pole or a telescopic pole depending on the height requirements needed for accessing the light bulb 4.

Figure 3:
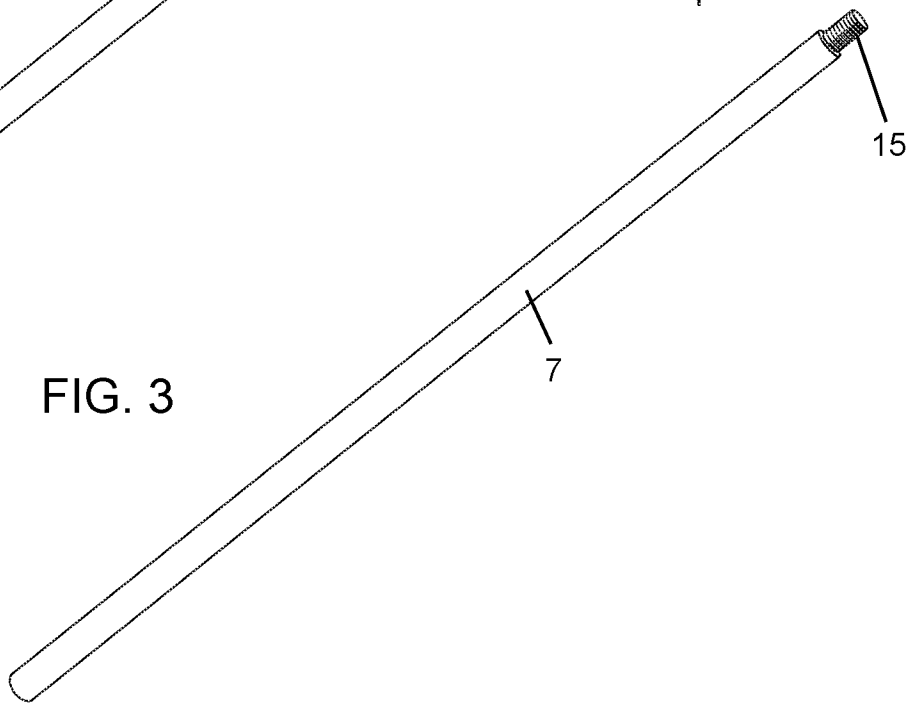
FIG. 3 is an exploded, perspective view of the light bulb extractor and/or replacement device.

FIGS. 2 and 3 show a first embodiment of the bulb extractor device 6 with a shortened version of the extension pole 7 as the pole length cannot fit into the page limitation. FIG. 3 shows an exploded view of the bulb extractor device 6 with special attention to the bulb removal/replacement head 8. The bulb removal/replacement head 8 is formed of three main components, including an extractor head 9, a bulb attachment head 10 and a double-sided adhesive ring 11. The extension pole 7 has a first threaded end 15 which engages with or into a first threaded end 16 of the bulb attachment head 10. The first threaded end 16 although shown to be cylindrical in shape may be any shape that is capable of bearing the threading for receiving and securing to the extension pole 7. A first side 18 of the double-sided adhesive ring 11 attaches to a second, flat and circular end 17 of the bulb attachment head 10 with an adhesive fit (e.g. the double-sided adhesive ring 11 has an adhesive layer on both of its sides 18, 19). A second side 19 of the double-sided adhesive ring 11 attaches to a bottom or first side 20 of the extractor head 9. In this manner the double-sided adhesive ring 11 attaches and holds the extractor head 9 to the bulb attachment head 10 by an adhesive connection.

By configuring the bulb extractor device 6 with the bulb attachment head 10, the double-sided adhesive ring 11 and the attached extractor head 9, the bulb extractor device 6 is configured for replacing a broken light bulb 4 residing in the high-hat light fixture 1.

FIGS. 4-7 show different views and embodiments of the extractor head 9.

Figure 4:
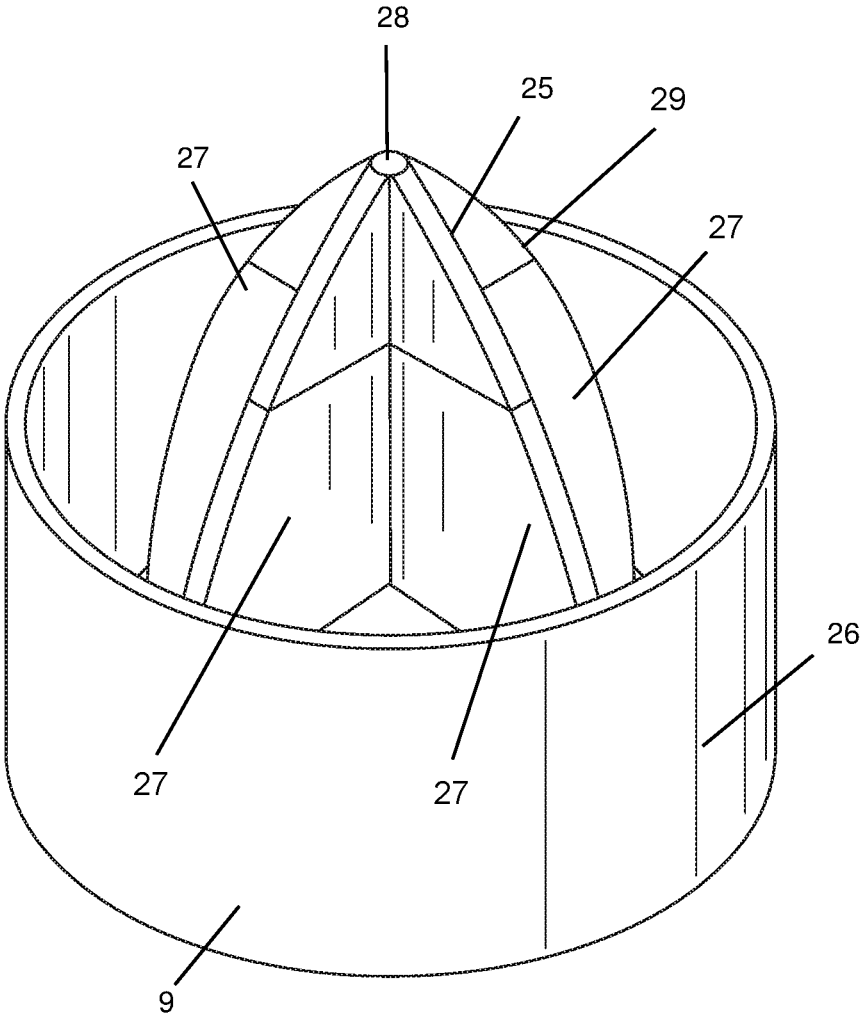
FIG. 4 is a perspective view of a first embodiment of the light bulb extractor head.
Figure 5:
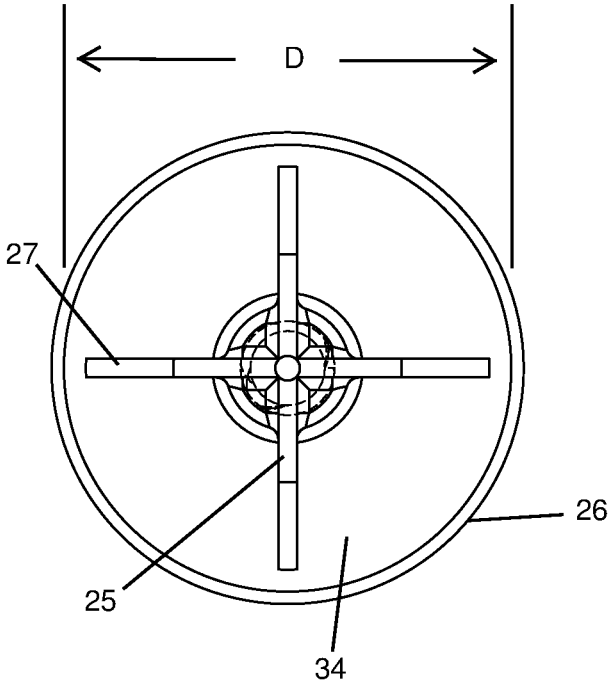
FIG. 5 is a top view of a second embodiment of the light bulb extractor head.

FIG. 4 is a perspective view of a first embodiment of the extractor head 9 having a bulb extractor 25 surrounded by a guide 26. The guide 26 is cylindrically shaped and configured for nestling directly in the high hat-light fixture 1 with little play (e.g. the guide 26 has almost the same dimensions as an opening to the high-hat light fixture). More specifically a diameter D of the guide 26 is within ¼-1 inch, ideally ½ inch, of a diameter d of the high-hat light fixture 1. Because of the little play between the circumference of the guide 26 and the walls of the high-hat light fixture 1, a self-centering of the extractor head 9 in the high-hat light fixture 1 is accomplished.

Figure 7:
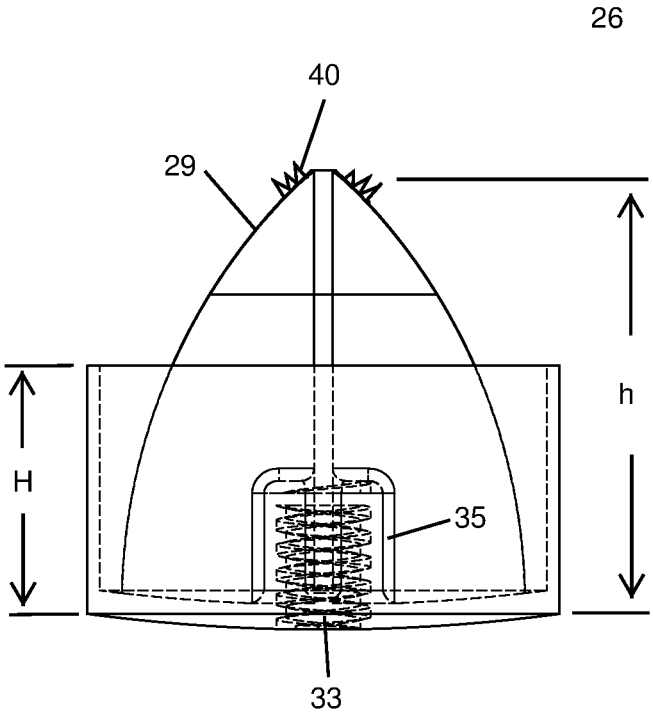
FIG. 7 is a sectional view of the light bulb extractor head with the addition of teeth.

The bulb extractor 25 is formed of four (4) blades 27 disposed at 90 intervals (e.g. 3, 5, 6 or 8 blades are also feasible). The four blades 27 meet at a center point 28 which defines a digging point or tip 28 for digging into a base of the broken light bulb 4. Each blade 27 is formed with a curved shape or arching taper 29 as best shown in FIGS. 4 and 7. Ideally, the curved shape or arching taper 29 of each of the blades 27 allows the bulb extractor 25 to fit into various sized bulbs by further extending into the base of the broken light bulb 4. Two of the blades 27 form a half oval and the bulb extractor 25 is formed from two intersecting half ovals. Furthermore, in a modified embodiment of the extractor head 9, the blades 27 have a teething or roughing 40 which provide a greater frictional engagement with the base of the light bulb 4, see FIG. 7. Please note the in FIG. 7 the teething or roughening 40 is exaggerated.

The blades 27 can be formed from various materials which each have their own advantages and disadvantages. More specifically, the blades 27 can be formed completely from a hard plastic. In this manner the digging tip 28 can penetrate deeply into the base 4' of the broken light bulb 4. A rotational force and a pushing force is applied to the extension pole 7 and the broken light bulb 4 is loosened in the light socket 3 and removed. However, due to the use of a hard plastic, frictional forces are reduced and slippage between the bulb extractor 25 and the broken light bulb 4 may occur upon turning of the extension pole 7.

In a second alternative embodiment, the blades 27 can be formed from a more elastic material. In this manner, the digging tip 28 can be squished into the base 4' of the broken light bulb 4 and has a more frictional engagement with the base 4' of the broken light bulb 4 for removing the broken light bulb 4. Furthermore, such an elastic tip 28 can deform to fit into various sized bases of the broken light bulb 4.

Figure 6:
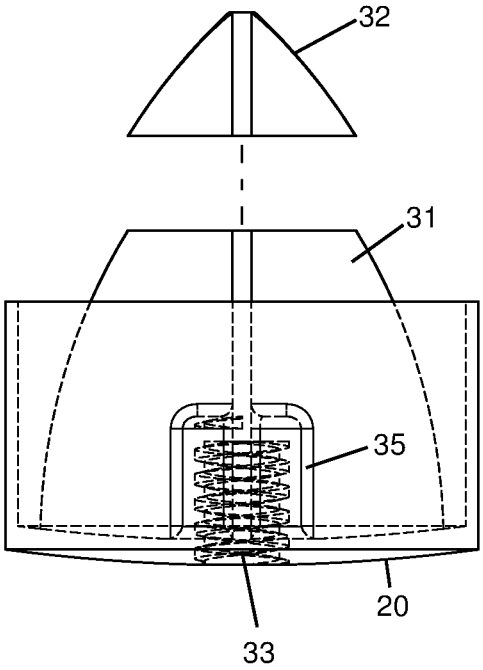
FIG. 6 is a partially exploded, side view of the second embodiment of the light bulb extractor head.

In a third embodiment, a bottom base 31 of the blades 27 is formed of a harder plastic and an upper section 32 is formed of a more flexible plastic or rubber, see FIG. 6. In this configuration, the hard plastic provides a stronger overall structure of the extractor head 9 and at the same time provides an elastic tip 28 for digging into the base 4' of the broken light bulb 4 and creating a greater frictional engagement with the light bulb 4.

In all three embodiments the guide 26 forms a pocket 34 into which broken glass can be collected and centers the tip 28 for engaging into the base 4' of any sized light bulb 4 that fits in the respective high-hat light fixture 1. The guide 26 has a height H that ideally extends approximately half way up a height h of the blades 27 which provides adequate centering ability and a deep enough pocket 34 for collecting sizable glass pieces that may break off. In addition, the guide 26 can be made of either a hard plastic or a flexible material as with the blades 27.

FIGS. 6 and 7 show a further refinement of the extractor head 9. The bottom side 20 of the extractor head 9 is configured with a threading 33 and can engage directly with the threading 15 of the extension pole 7 and therefore the bulb attachment head 10 and the double-side adhesive ring 11 are not necessary. As shown in FIGS. 6 and 7, the threading 33 is formed in a cylindrical body 35 which extends into the pocket 34 and around which the blades 27 are attached to and extend from.

Figure 8:
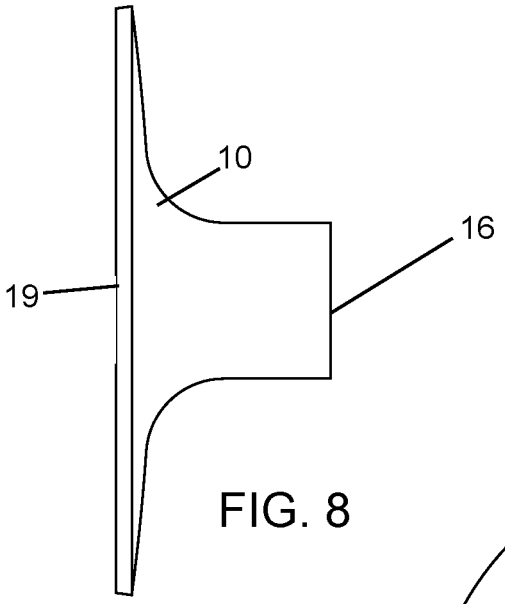
FIG. 8 is a side view of the light bulb replacement unit.
Figure 10:
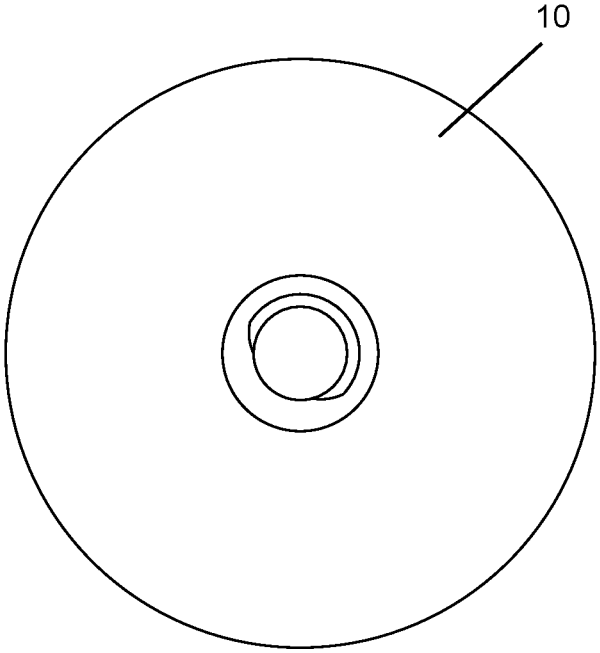
FIG. 10 is a rear view of the light bulb replacement unit.
Figure 9:
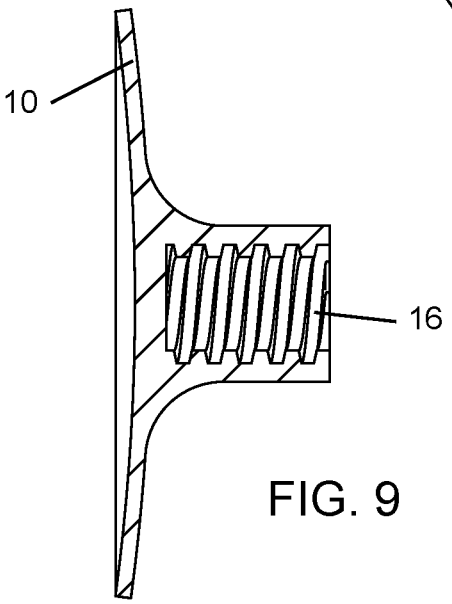
FIG. 9 is a sectional view of the light bulb replacement unit.

By configuring the extractor device 6 with only the bulb attachment head 10 and the adhesive ring 11 (e.g. without the extractor head 9), the bulb extractor device 6 is configured for replacing an unbroken bulb 4 in the high-hat light fixture 1. As shown in FIGS. 8-10, the bulb attachment head 10 is ideally circular in shape and has a diameter being approximately equal to that of a front face of a light bulb 4 to be removed, albeit slightly smaller. The exposed adhesive side 19 of the double-sided adhesive ring 11 is raised and placed in front of a front face of the light bulb 4 to be replaced. Then the adhesive side 19 is pressed on the front face of the light bulb 4. A rotational force is now applied to the extension pole 7 and the light bulb 4 is removed from the light socket 3. The extension pole 7 is lowered and old light bulb is pulled off of the double-sided adhesive ring 11. A new light bulb is attached to the double-sided adhesive ring 11 and the extension pole 7 is raised so that the new light bulb 4 can be screwed into the light socket 3. At this point a quick snap or pull of the extension pole 7 releases the adhesive bond between the double-sided adhesive ring 11 and new light bulb secured in the light socket 3.

In essence, the bulb extractor device 6 is configured for replacing undamaged burned out light bulbs and damaged light bulbs. The bulb extractor device 6 is ideally formed to remove broken light bulbs fitted in high-hat light fixtures 1 as it automatically centers the bulb extractor in the base of the damaged light bulb.

The invention claimed is:

1. A light bulb remover for extracting a broken light bulb from a socket of a high-hat light fixture, the light bulb remover comprising:

an extension pole having a first end and a second end;

an extractor head attached to said extension pole and having a guide defining an outer circumference of said extractor head, said extractor head having a bulb extractor configured for engaging in a base of the broken light bulb and creating a friction connection with the base of the light bulb, said bulb extractor being surrounded by said guide, said guide having a diameter being less than a diameter of the high-hat light fixture and dimensioned so that when the light bulb remover is disposed within the high-hat light fixture said bulb extractor is self-aligned with a middle area of the base of the broken light bulb.

2. The light bulb remover according to claim 1, wherein said guide is cylindrically shaped and completely surrounds said extractor.

3. The light bulb remover according to claim 1, wherein said bulb extractor has a plurality of blades and a point of intersection of said blades defines a tip for jabbing into the base of the broken light bulb.

4. The light bulb remover according to claim 3, wherein each of said blades has a distal end and a first end tapering towards said distal end, and said tip is formed where said distal end of said blades meet.

5. The light bulb remover according to claim 4, wherein said extractor head has a circularly shaped bottom.

6. The light bulb remover according to claim 5, wherein each of said blades has a lower portion and an upper portion, said lower portion extending up from said circularly shaped bottom, and said upper portion has a first side extending from said lower portion and a second side defining said tip.

7. The light bulb remover according to claim 6, wherein said upper portion is formed from a softer material than said lower portion.

8. The light bulb remover according to claim 3, wherein said guide circumferential surrounds said plurality of blades.

9. The light bulb remover according to claim 5, wherein:

said first end of said extension pole is a threaded first end; and said circularly shaped bottom of said extractor head has a threaded central core for engaging with said threaded first end of said extension pole.

10. The light bulb remover according to claim 5, wherein said extension pole is a telescopic extension pole.

11. The light bulb remover according to claim 5, wherein said guide is disposed distally from said bulb extractor and with said circularly shaped bottom forms a pocket for receiving broken glass from the broken light bulb.

12. The light bulb remover according to claim 5, wherein:

said bulb extractor extends vertically from said circularly shaped bottom and has a first height; and said guide extends vertically from said circularly shaped bottom and has a second height, wherein said first height is greater than said second height.

13. The light bulb remover according to claim 1, wherein the diameter of said guide is within ¼-¾ an inch of the diameter of the high-hat light fixture.

14. A light bulb remover for extracting a broken light bulb from a socket of a cylindrical high-hat light fixture having a diameter, the light bulb remover comprising:

an extension pole having a first end and a second end defining a longitudinal direction of said extension pole;

an extractor head attached to said extension pole and having a guide defining an outer circumference of said extractor head, said extractor head having a bulb extractor having blades configured for engaging in a base of the broken light bulb and creating a connection with the base of the light bulb, said blades having a blade longitudinal extent in said longitudinal direction, said guide having a guide longitudinal extent in said longitudinal direction overlapping said blade longitudinal extent and said guide surrounding said blades, said guide having a diameter being less than the diameter of the high-hat light fixture and dimensioned so that when the light bulb remover is disposed within the high-hat light fixture said bulb extractor is self-aligned with a middle area of the base of the broken light bulb.

* * * * *